US008480204B2

(12) United States Patent
Fukasawa et al.

(10) Patent No.: US 8,480,204 B2
(45) Date of Patent: Jul. 9, 2013

(54) LIQUID EJECTING APPARATUS

(75) Inventors: Shigenori Fukasawa, Shiojiri (JP); Hideya Yokouchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 240 days.

(21) Appl. No.: 13/026,198

(22) Filed: Feb. 11, 2011

(65) Prior Publication Data

US 2011/0199427 A1 Aug. 18, 2011

(30) Foreign Application Priority Data

Feb. 12, 2010 (JP) ..... 2010-028877

(51) Int. Cl.
*B41J 2/165* (2006.01)

(52) U.S. Cl.
USPC ..... 347/30

(58) Field of Classification Search
USPC ..... 347/22–23, 29–30, 35
See application file for complete search history.

(56) References Cited

U.S. PATENT DOCUMENTS 6,364,449 B1 4/2002 Takahashi et al.
7,401,889 B2 * 7/2008 Iwasaki ..... 347/29
7,735,957 B2 * 6/2010 Kudo et al. ..... 347/30

FOREIGN PATENT DOCUMENTS

JP 2000-153622 A 6/2000

* cited by examiner

*Primary Examiner* — Lamson Nguyen
(74) *Attorney, Agent, or Firm* — Kilpatrick Townsend & Stockton LLP

(57) ABSTRACT

A liquid ejecting apparatus includes: a head portion which ejects liquid; a plurality of liquid reception portions which receive the liquid discharged from the head portion and in which flow-out ports of the liquid are provided on the bottoms; a suction pump which is connected to each of the flow-out ports of the plurality of the liquid reception portions and sucks the flow-out ports; and closure members each of which is provided in each of the plurality of liquid reception portions, is formed so as to float in the liquid, and closes each of the flow-out ports in a state where the liquid has flown out.

4 Claims, 6 Drawing Sheets

LIQUID EJECTING APPARATUS

BACKGROUND

1. Technical Field

The present invention relates to a liquid ejecting apparatus.

2. Related Art

An ink jet recording apparatus which records a character, an image, or the like onto a recording medium, is known as a liquid ejecting apparatus which ejects liquid. Such ink jet recording apparatus ejects ink onto a recording medium through nozzles provided in an ejection head while transporting the recording medium so that a character, an image, or the like is formed on the recording medium. A cap which covers an ejection region of the ejection head is provided in the ink jet recording apparatus.

In an ink jet recording apparatus, a printing failure is caused in some case. The printing failure is caused because nozzles of an ejection head are clogged due to increase in viscosity of ink, solidification of ink, attachment of dusts, further, mixing of air bubbles, or the like. Further, when ink is initially filled into an ejection head, liquid in the head is required to be discharged through nozzles. Therefore, an ink jet ejecting apparatus is configured to perform a maintenance operation such as a flushing operation in which liquid in the nozzles is forcibly discharged, separately from ejection onto a recording medium.

In the flushing operation, liquid discharged from the ejection head is received by using a liquid reception portion such as a cap. A flow-out port from which the received ink flows out is provided in the cap, for example. A suction portion such as a pump is connected to the flow-out port, for example.

In recent years, an ink jet recording apparatus using inks of multiple colors such as magenta, light magenta, cyan, light cyan, yellow, and black has been proposed in order to improve printing quality at the time of color printing. When inks of multiple colors are used in such a manner, nozzle opening rows corresponding to the number of colors are required to be provided in an ejection head. Therefore, for example, a configuration in which a plurality of ejection heads are mounted on one carriage has been known (for example, see JP-A-2000-153622). In the configuration disclosed in JP-A-2000-153622, a plurality of caps each of which corresponds to each of the plurality of ejection heads are provided and a separate pump is connected to each cap.

However, the configuration in which a separate pump is connected to each of the plurality of caps is preferable in terms of maintenance properties such as suction accuracy but increases in cost.

SUMMARY

An advantage of some aspects of the invention is to provide a liquid ejecting apparatus which can realize reduction in cost.

A liquid ejecting apparatus according to an aspect of the invention includes: a head portion which ejects liquid; a plurality of liquid reception portions which receive the liquid discharged from the head portion and in which flow-out ports of the liquid are provided on the bottoms; a suction portion which commonly sucks the flow-out ports of the plurality of the liquid reception portions; and closure members each of which is provided in each of the plurality of liquid reception portions, is formed so as to float in the liquid, and closes each of the flow-out ports in a state where the liquid has flown out.

With the aspect of the invention, when liquid is present in the liquid reception portion, the closure member floats in the liquid. Therefore, the liquid is interposed between the closure member and the flow-out port. On the other hand, as the liquid flows out from the liquid reception portion and a liquid level in the liquid reception portion becomes lower, the closure member becomes closer to the flow-out port. Then, the flow-out port is closed by the closure member in a state where the liquid has flown out. In such a manner, when liquid is not present in the liquid reception portion, the flow-out port is closed. Therefore, even when flow-out ports of the plurality of liquid reception portions are sucked by one suction pump, suction missing can be prevented from occurring. Accordingly, the suction pump is not required to be provided separately on every flow-out port. This makes it possible to realize reduction in cost.

In the above liquid ejecting apparatus, it is preferable that the head portion have a plurality of liquid ejection regions, and the liquid reception portion be provided in each of the liquid ejection regions.

According to the aspect of the invention, the head portion has a plurality of liquid ejection regions and the liquid reception portion is provided in each of the liquid ejection regions. Therefore, suction can be reliably performed in each of the plurality of liquid ejection regions.

In the above liquid ejecting apparatus, it is preferable that the head portion have a plurality of ejection heads, and the liquid ejection region be provided on each of the ejection heads.

According to the aspect of the invention, in a configuration where a plurality of ejection heads are provided and a liquid ejection region is provided in each of the ejection heads, suction can be also reliably performed in each of the liquid ejection regions.

In the above liquid ejecting apparatus, it is preferable that the head portion have a liquid ejection face which ejects the liquid, and the plurality of liquid reception portions be formed so as to cover the liquid ejection face.

According to the aspect of the invention, since the liquid reception portions are formed so as to cover the liquid ejection face, even when the flow-out ports are closed by the closure members, the liquid ejection face is protected.

A liquid ejecting apparatus according to another aspect of the invention includes a head portion having a liquid ejection face which ejects liquid, a plurality of liquid reception portions which are formed so as to cover the liquid ejection face and receive the liquid discharged from the head portion and in which flow-out ports of the liquid are provided on the bottoms, a suction pump which is connected to each of the flow-out ports of the plurality of the liquid reception portions and sucks the flow-out ports, a valve which is provided on each of the flow-out ports and switches open and close states of the flow-out ports, and a valve controller which closes the flow-out port of the liquid reception portion from which the liquid has flown out in a state where the liquid ejection face is covered by the plurality of liquid reception portions and the liquid in at least one liquid reception portion has flown out.

According to the aspect of the invention, the flow-out port of the liquid reception portion from which the liquid has flown out is closed in a state where the liquid ejection face is covered by the plurality of liquid reception portions and the liquid in at least one liquid reception portion has flown out. Therefore, even when a plurality of liquid reception portions are commonly sucked by one suction pump, suction missing can be prevented from occurring. Accordingly, the suction pump is not required to be provided separately on each of the flow-out ports. This makes it possible to realize reduction in cost.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention are described with reference to the drawings.

Figure 1:
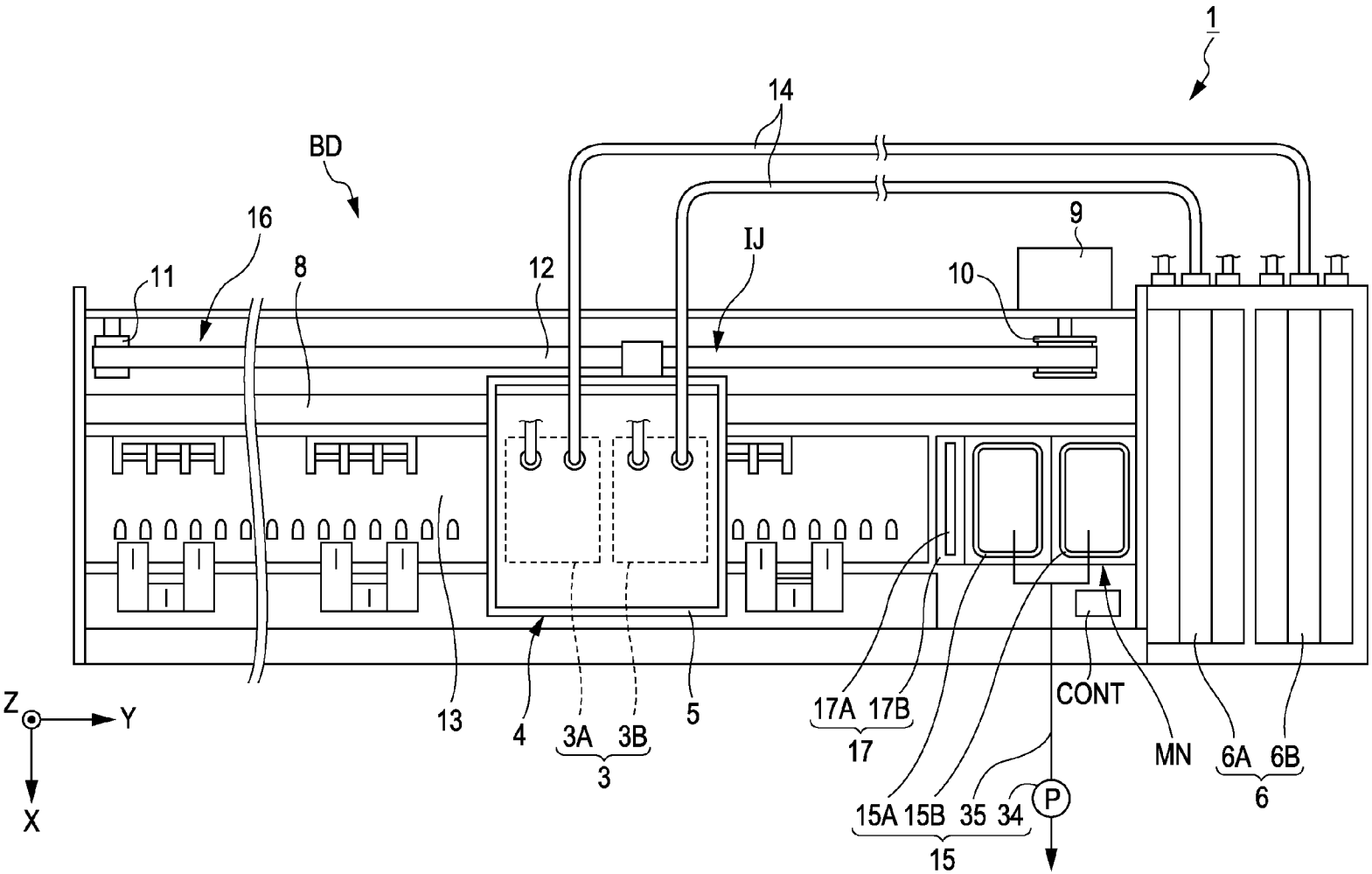
FIG. 1 is a view illustrating a configuration of an ink jet printer according to a first embodiment of the invention.

FIG. 1 is a view illustrating a schematic configuration of an ink jet printer 1 (liquid ejecting apparatus) according to a first embodiment.

As illustrated in FIG. 1, the ink jet printer 1 has a printer main body BD, an ink ejection mechanism IJ, a maintenance mechanism MN and a control device CONT. Further, the ink jet printer 1 has a recording medium transportation mechanism (not shown). The ink jet printer 1 is an apparatus which records a character, an image, or the like onto a recording medium (paper, a plastic sheet, or the like) by the ink ejection mechanism IJ while transporting the recording medium by the recording medium transportation mechanism. Each of the recording medium transportation mechanism, the ink ejection mechanism IJ, the maintenance mechanism MN and the control device CONT is installed in the printer main body BD.

Hereinafter, an XYZ orthogonal coordinate system is set and a positional relationship of each component is described with reference to the XYZ orthogonal coordinate system appropriately. In the embodiment, a transportation direction of a recording medium is indicated as an X direction, a direction perpendicular to the X direction on a transportation plane of the recording medium is indicated as a Y direction, and a direction perpendicular to a plane including the X axis and the Y axis is indicated as a Z direction. Further, a rotational direction about the X axis is indicated as a θX direction, a rotational direction about the Y axis is indicated as a θY direction and a rotational direction about the Z axis is indicated as a θZ direction.

A platen 13 is arranged on a transportation path of a recording medium. The platen 13 is attached to the printer main body BD, for example, and has a supporting face which supports a recording medium. The supporting face of the platen 13 faces to the +Z direction, for example, and is formed so as to be in parallel with the XY plane.

The ink ejection mechanism IJ has a head portion 3, a head portion movement mechanism 4 and an ink storage portion 6.

Figure 2:
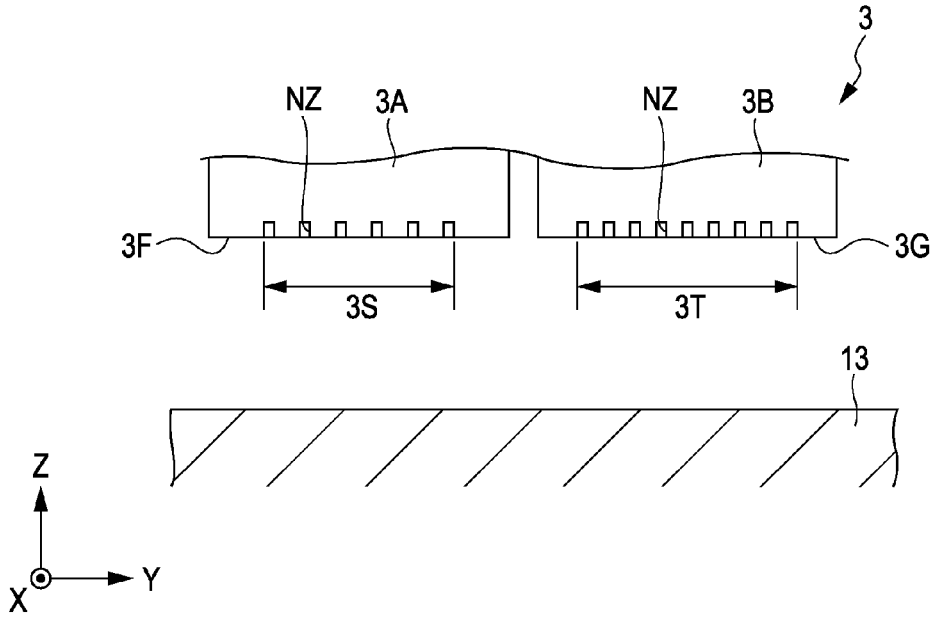
FIG. 2 is a view illustrating a configuration of a head portion according to the embodiment.

The head portion 3 is a portion which ejects ink onto a recording medium. FIG. 2 is a side cross-sectional view illustrating a configuration of the head portion 3. As illustrated in FIG. 2, the head portion 3 has two ejection heads 3A and 3B. Each of the ejection heads 3A and 3B is fixed to the head portion movement mechanism 4. The ejection heads 3A and 3B are arranged side by side in the Y direction. Faces of the ejection heads 3A and 3B at the −Z side correspond to nozzle faces (liquid ejection faces) 3F and 3G, respectively.

A plurality of nozzles NZ which discharge ink are provided in the nozzle faces 3F and 3G. The plurality of nozzles NZ are linearly arranged in the X direction. A plurality of nozzle rows are formed in the nozzle faces 3F and 3G. Regions in which nozzle rows are formed in the nozzle faces 3F and 3G correspond to liquid ejection regions 3S and 3T. The ejection heads 3A and 3B are arranged such that the nozzle faces 3F and 3G thereof are opposed to the platen 13, for example. The ejection heads 3A and 3B eject inks of which colors are different from each other.

Returning to FIG. 1, the head portion movement mechanism 4 has a carriage 5 and a carriage movement mechanism 16. The carriage 5 is a portion which fixes the ejection heads 3A and 3B of the head portion 3. The carriage 5 is provided so as to be movable in the Y direction by the carriage movement mechanism 16, for example.

The carriage movement mechanism 16 has a guiding shaft 8, a pulse motor 9, a main driving pulley 10, a driven pulley 11 and a timing belt 12. The guiding shaft 8 is attached to the printer main body BD so as to be in parallel with the Y direction, and guides the carriage 5 to move in the Y direction. The pulse motor 9 has a rotational shaft so as to rotate in the θX direction. The main driving pulley 10 is connected to the rotational shaft of the pulse motor 9. The driven pulley 11 is provided at an opposite side to the main driving pulley 10 in the Y direction of the printer main body BD. The timing belt 12 is an endless belt which is wound over the main driving pulley 10 and the driven pulley 11. The carriage 5 is fixed to the timing belt 12. The carriage 5 reciprocates in the Y direction along the guiding shaft 8 by driving the pulse motor 9.

The ink storage portion 6 is a portion in which ink to be supplied to the head portion 3 is stored. The ink storage portion 6 is connected to the head portion 3 through ink supply tubes 14. The ink storage portion 6 has a plurality of (for example, three) ink cartridges 6A and a plurality of (for example, three) ink cartridges 6B. The plurality of ink cartridges 6A are connected to the ejection head 3A of the head portion 3 and the plurality of ink cartridges 6B are connected to the ejection head 3B of the head portion 3. Inks of magenta, light magenta, cyan, light cyan, yellow, and black are stored in the ink cartridges 6A and 6B. It is needless to say that the configurations of the ink storage portion 6 including the number of the ink cartridges 6A and 6B, and combinations of ink colors are not limited to the above examples.

The maintenance mechanism MN has a capping mechanism 15 and a wiping mechanism 17. The wiping mechanism 17 wipes off ink adhered to the ejection heads 3A and 3B, for example.

The capping mechanism 15 is used for a suction operation in which ink whose viscosity has increased is sucked through nozzles, a flushing operation in which ink ejected or discharged from the ejection heads 3A and 3B is received, and so on. The capping mechanism 15 has two cap members 15A and 15B, and one suction pump 34.

The capping mechanism 15 is arranged at a home position in the printer main body BD, for example. The home position is a position at which the carriage 5 is arranged when the ink jet printer 1 is powered-off or when recording is not performed for a long period of time. The home position is set to be a region within a movement range of the carriage 5 and outside a region in which a recording medium is arranged, for example. In the embodiment, the home position is set in the movement region of the carriage 5 at a +Y side end.

Figure 3:
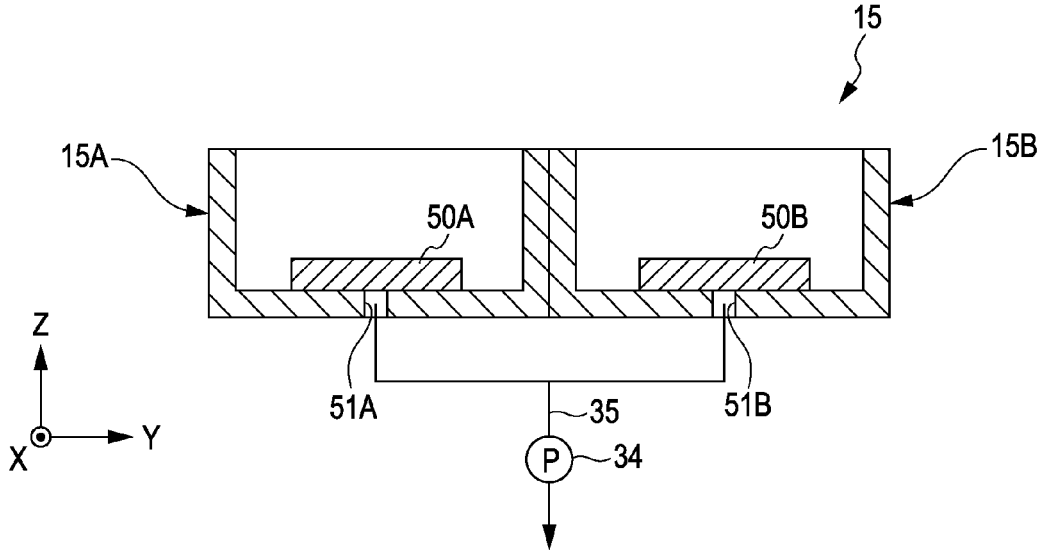
FIG. 3 is a view illustrating a configuration of a capping mechanism according to the embodiment.

FIG. 3 is a cross-sectional view illustrating a configuration of the capping mechanism 15.

As illustrated in FIG. 1 and FIG. 3, the cap members 15A and 15B are arranged side by side in the Y direction. The ejection head 3A and the cap member 15A are opposed to each other and the ejection head 3B and the cap member 15B are opposed to each other in a state where the carriage 5 is arranged at the home position.

As illustrated in FIG. 3, the cap member 15A and the cap member 15B are formed in a recess form so as to receive the above inks. The cap members 15A and 15B have ink flow-out ports 51A and 51B on the bottoms thereof, respectively. Further, closure members 50A and 50B are arranged on the bottoms of the cap members 15A and 15B so as to be superimposed on the flow-out ports 51A and 51B, respectively.

The closure members 50A and 50B are formed with a material which floats in ink, for example. Further, the closure members 50A and 50B are formed to have such dimensions that the closure members 50A and 50B can be superimposed on the flow-out ports 51A and 51B even in a case where the closure members 50A and 50B move in the recesses of the cap members 15A and 15B in the XY direction. FIG. 3 illustrates a state where ink is not present in each of the cap members 15A and 15B. In such a case, the flow-out ports 51A and 51B are closed by the closure members 50A and 50B, respectively.

A tube member 35 is connected to each of the flow-out ports 51A and 51B. One end of the tube member 35 is connected to the suction pump 34. The other end of the tube member 35 is branched into two. One end of the branched two ends is connected to the flow-out port 51A and the other end thereof is connected to the flow-out port 51B. Therefore, both of the flow-out ports 51A and 51B are connected to one suction pump 34.

Next, one example of an operation of the ink jet printer 1 having the above configuration is described.

If print data is transmitted from the outside, a controller (not shown) converts the print data to ejection data corresponding to a dot pattern so as to transmit the ejection data to the ejection heads 3A and 3B. In the ejection heads 3A and 3B, recording (printing) processing, that is, ejection of ink droplets onto a recording paper is executed based on the received ejection data.

After such recording processing is performed, when the operation is judged to be continued, for example, if a predetermined period of time has passed, a periodic maintenance processing is commenced. Further, after the recording processing is performed, when the operation is not judged to be continued, the processing with the ink jet printer 1 ends. Hereinafter, a case where the operation is judged to be continued is described.

In the embodiment, a case where a flushing processing is performed as a maintenance processing is described. The control device CONT controls each of the ejection heads 3A and 3B to move to the home position. With the operation, the ejection head 3A and the cap member 15A are opposed to each other and the ejection head 3B and the cap member 15B are opposed to each other.

Figure 4:
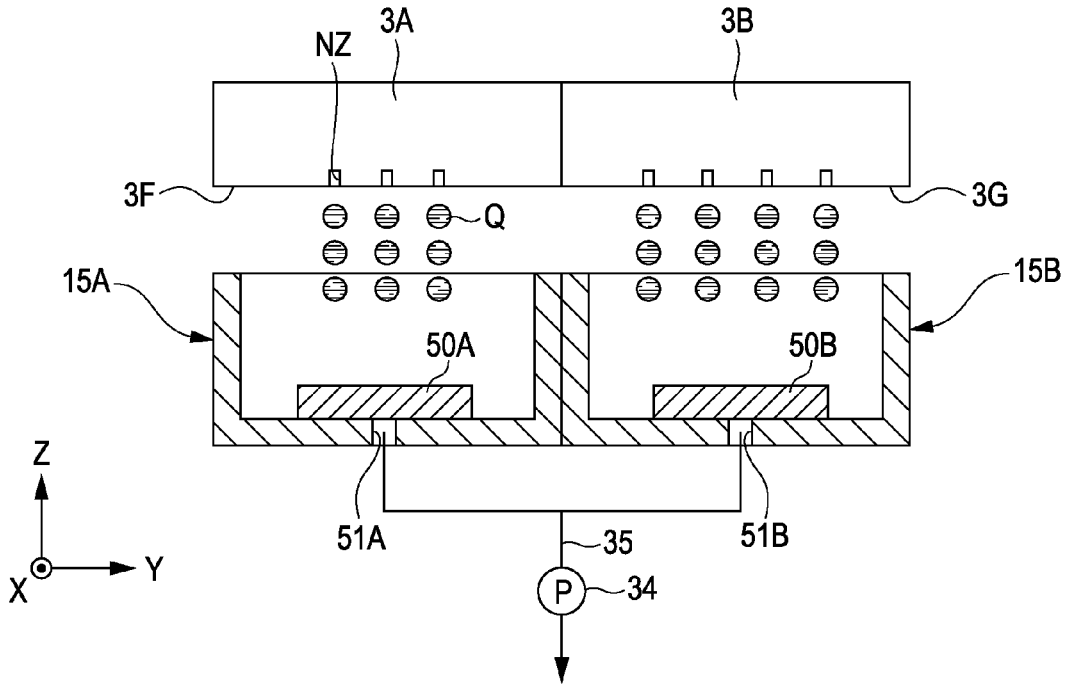
FIG. 4 is a view illustrating a process of a maintenance operation using the capping mechanism according to the embodiment.

In this state, the control device CONT controls each of the ejection heads 3A and 3B to discharge ink Q as illustrated in FIG. 4. The discharged ink Q is accommodated in each of the recesses of the cap members 15A and 15B. In the embodiment, a discharge amount of ink Q ejected from the ejection head 3B is larger than that of ink Q ejected from the ejection head 3A.

Figure 5:
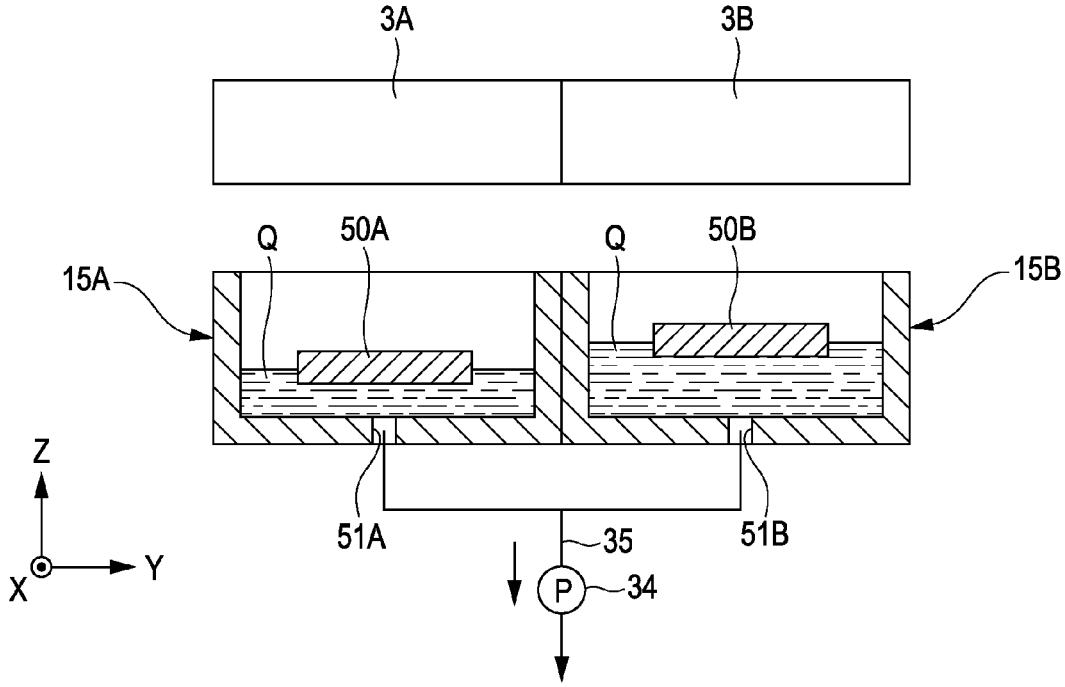
FIG. 5 is an operation view illustrating a process of the maintenance operation using the capping mechanism according to the embodiment.

FIG. 5 illustrates a state where the ink Q is received by each of the cap members 15A and 15B. As illustrated in FIG. 5, the ink Q is accommodated in each of the cap members 15A and 15B so that each of the closure members 50A and 50B floats in the ink Q. Therefore, the ink Q is interposed between the flow-out port 51A and the closure member 50A and between the flow-out port 51B and the closure member 50B. Since the discharge amount of ink Q ejected from the ejection head 3B is larger than that of ink Q ejected from the ejection head 3A, a liquid level of the ink Q in the cap member 15B is higher than that in the cap member 15A.

In this state, the control device CONT controls the suction pump 34 to drive, for example. With the operation, the flow-out ports 51A and 51B are sucked and the ink Q accommodated in each of the cap member 15A and the cap member 15B flows out from each of the flow-out ports 51A and 51B. The flown-out ink Q is discharged to the outside through the tube member 35.

Figure 6:
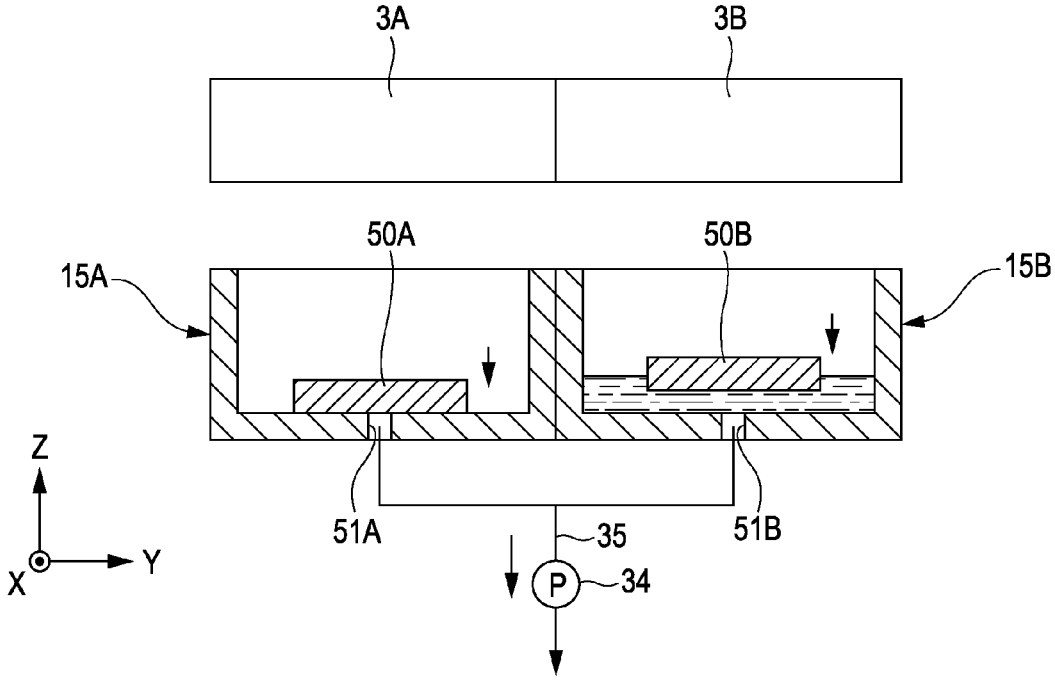
FIG. 6 is an operation view illustrating a process of the maintenance operation using the capping mechanism according to the embodiment.

In the embodiment, an amount of ink Q accommodated in the cap member 15A is smaller than that of the ink Q accommodated in the cap member 15B. Therefore, as the suction operation proceeds, all the ink Q in the cap member 15A flows out first as illustrated in FIG. 6. If all the ink Q flows out, the closure member 50A makes contact with the bottom of the cap member 15A. Then, the flow-out port 51A is closed by the closure member 50A. Therefore, after all the ink Q in the cap member 15A flows out, only the flow-out port 51B of the cap member 15B is sucked without causing suction missing of the cap member 15A.

Figure 7:
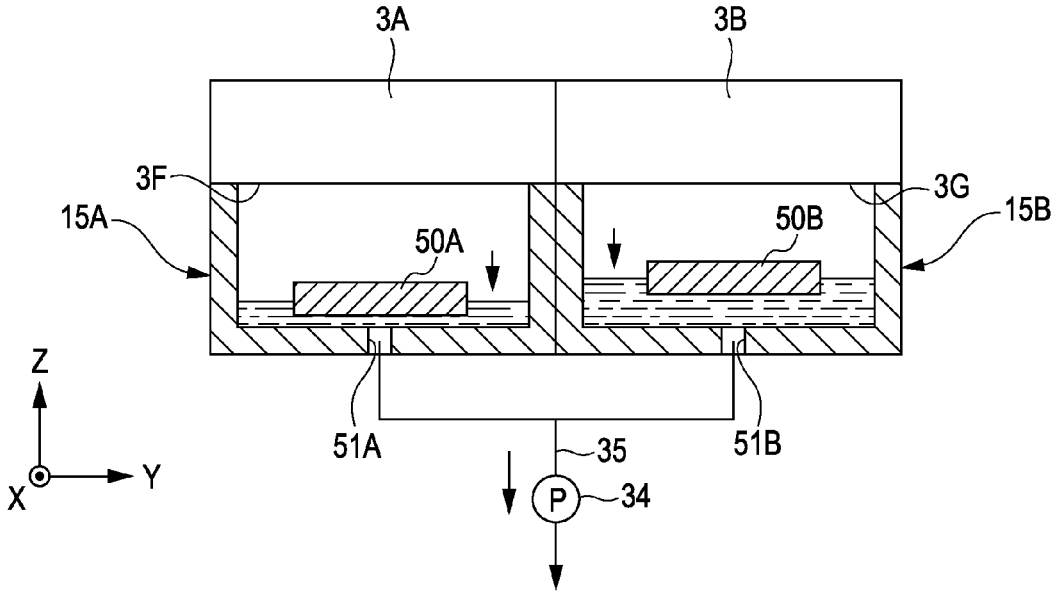
FIG. 7 is an operation view illustrating a process of the maintenance operation using the capping mechanism according to the embodiment.

It is to be noted that when the flow-out ports 51A and 51B are sucked, the suction may be performed in the following state. For example, the flow-out ports 51A and 51B may be sucked in a state where after the closure members 50A and 50B are once floated, the nozzle faces 3F and 3G of the ejection heads 3A and 3B are covered by the cap members 15A and 15B, respectively, as illustrated in FIG. 7. In this case, the liquid levels in the cap members 15A and 15B change so that negative pressures are generated between the cap member 15A and the nozzle face 3F and between the cap member 15B and the nozzle face 3G. Since ink can be discharged through the nozzles NZ with the negative pressures, states of the nozzles NZ can be kept.

Further, liquid such as ink may be accommodated in each of the cap members 15A and 15B so as to make each of the closure members 50A and 50B float at the time of factory shipment. In this case, when the ink Q is initially filled into the ejection heads 3A and 3B from the ink cartridges 6A and 6B, respectively, the nozzle faces 3F and 3G of the ejection heads 3A and 3B are sealed by the cap members 15A and 15B, respectively, so as to operate the suction pump 34. With the operation, liquid which has been accommodated flows out from each of the flow-out ports 51A and 51B. At the same time, negative pressures are generated in the cap members 15A and 15B because the liquid levels in the cap members 15A and 15B lower. Therefore, ink Q can be filled into the ejection heads 3A and 3B with the negative pressures.

As described above, according to the embodiment, when ink Q is not present in one of the cap member 15A and the cap member 15B, the flow-out port 51A or 51B is closed by the closure member 50A or 50B. Therefore, even when the plurality of flow-out ports 51A and 51B are both sucked by one suction pump 34, suction missing can be prevented from occurring. Accordingly, the suction pump 34 is not required to be provided separately on both the flow-out ports 51A and 51B. This makes it possible to realize reduction in cost.

Second Embodiment

Figure 8:
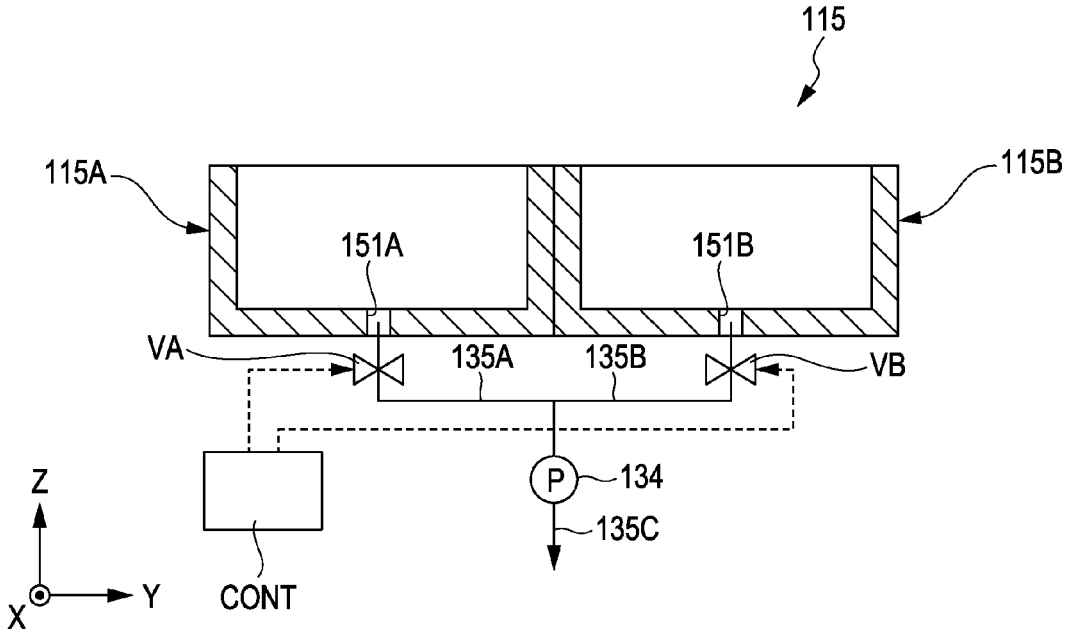
FIG. 8 is a view illustrating a configuration of a capping mechanism according to a second embodiment of the invention.

Next, a second embodiment of the invention is described. FIG. 8 is a view illustrating a configuration of a capping mechanism 115 according to the embodiment.

As illustrated in FIG. 8, the capping mechanism 115 has a cap member 115A and a cap member 115B. The cap members 115A and 115B have the same configuration as the cap members described in the first embodiment.

In the embodiment, tube members 135A and 135B are connected to flow-out ports 151A and 151B, respectively. The tube members 135A and 135B are connected to a tube member 135C and a suction pump 134 is attached to the tube member 135C. Therefore, both of the flow-out ports 151A and 151B are connected to one suction pump 134.

Further, in the embodiment, opening/closing valves VA and VB are attached to the tube members 135A and 135B, respectively. Open and close states of the opening/closing valves VA and VB are individually switched by the control device CONT. At this time, the open and close states of the opening/closing valves VA and VB are switched in a state where the cap members 115A and 115B cover the nozzle faces 3F and 3G of the ejection heads 3A and 3B, respectively.

Next, a case where the flushing is performed is described. The control device CONT controls each of the ejection heads 3A and 3B to move to the home position so that the ejection head 3A and the cap member 115A are opposed to each other and the ejection head 3B and the cap member 115B are opposed to each other.

In this state, the control device CONT controls each of the ejection heads 3A and 3B to discharge ink Q. The discharged ink Q is accommodated in each of the recesses of the cap members 115A and 115B. In the embodiment, as in the first embodiment, a case where a discharge amount of ink Q ejected from the ejection head 3B is larger than that of ink Q ejected from the ejection head 3A is described as an example.

Figure 9:
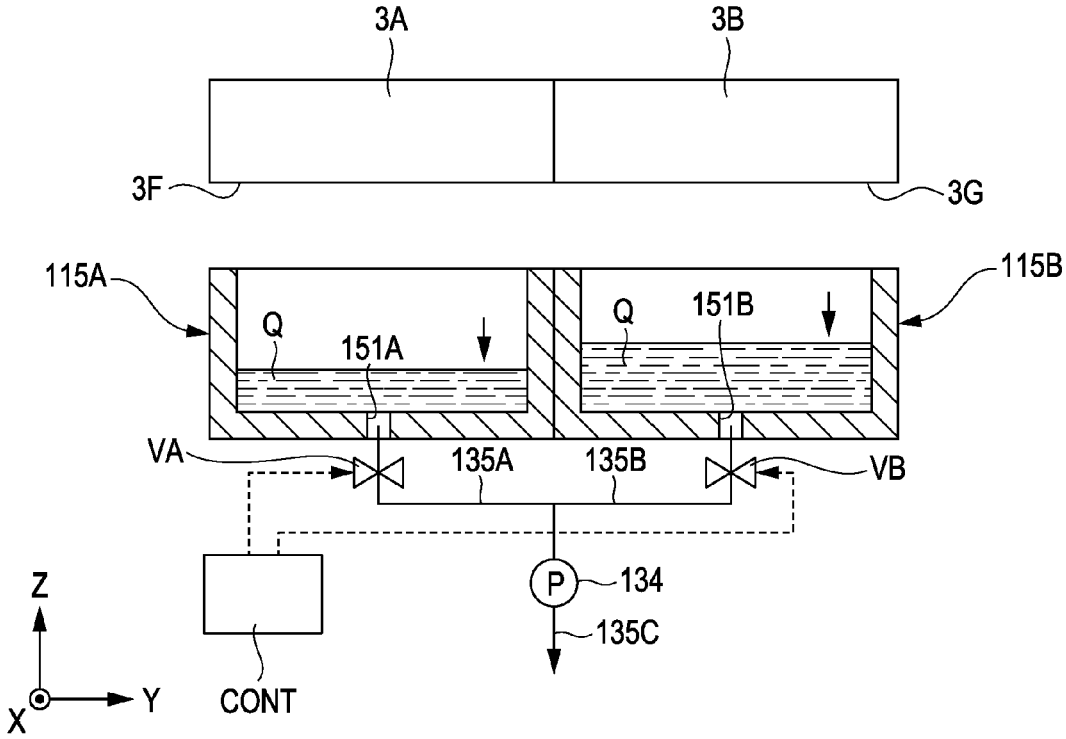
FIG. 9 is a view illustrating a process of a maintenance operation using the capping mechanism according to the embodiment.

FIG. 9 illustrates a state where ink Q is received by each of the cap members 115A and 115B. Also in the embodiment, since the discharge amount of ink Q ejected from the ejection head 3B is larger than that of ink Q ejected from the ejection head 3A, a liquid level of the ink Q in the cap member 115B is higher than that in the cap member 115A.

In this state, the control device CONT controls the suction pump 134 to drive, for example. With the operation, the flow-out ports 151A and 151B are sucked and the ink Q accommodated in each of the cap member 115A and the cap member 115B flows out from each of the flow-out ports 151A and 151B. The flown-out ink Q is discharged to the outside through the tube member 135C.

Figure 10:
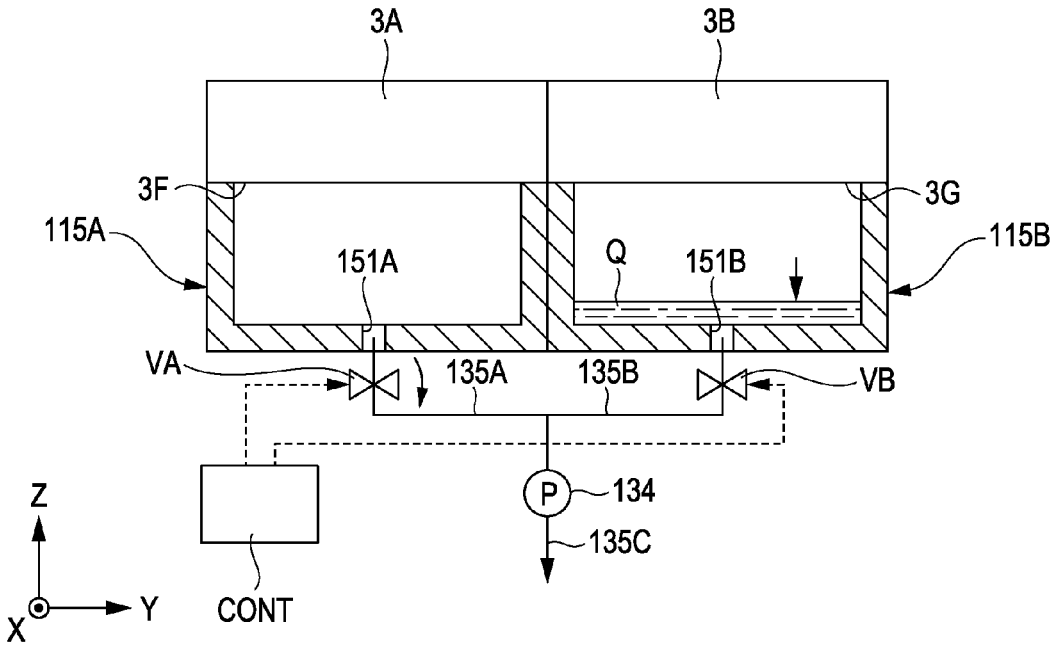
FIG. 10 is an operation view illustrating a process of the maintenance operation using the capping mechanism according to the embodiment.

In the embodiment, an amount of the ink Q accommodated in the cap member 115A is smaller than that of the ink Q accommodated in the cap member 115B. Therefore, as the suction operation proceeds, all the ink Q in the cap member 115A flows out first. Then, the control device CONT controls the cap member 115A and the cap member 115B to abut against the nozzle faces 3F and 3G of the ejection heads 3A and 3B, respectively, as illustrated in FIG. 10. In this state, the opening/closing valve VA of the tube member 135A which is connected to the flow-out port 151A is made to be in the closed state. Therefore, after all the ink Q in the cap member 115A flows out, only the flow-out port 151B of the cap member 115B is sucked without causing suction missing of the cap member 115A.

As described above, in the embodiment, the flow-out port 151A of the cap member 115A is covered in a state where the nozzle faces 3F and 3G are covered by the plurality of the cap members 115A and 115B and all the ink Q in at least the cap member 115A flows out. Therefore, even when the flow-out ports 151A and 151B are both sucked by one suction pump 134, suction missing can be prevented from occurring. Accordingly, the suction pump 134 is not required to be provided separately on both the flow-out ports 151A and 151B. This makes it possible to realize reduction in cost.

The technical range of the invention is not limited to the above embodiments and the embodiments can be modified in a range without departing from the scope of the invention.

For example, in the above embodiments, the head portion 3 has two ejection heads 3A and 3B. However, the configuration of the head portion 3 is not limited thereto. The head portion 3 may have one ejection head or three or more ejection heads. Further, when the head portion 3 has one ejection head, a plurality of ejection regions may be arranged for one ejection head.

In the above description, an ink jet printer and an ink cartridge are employed. However, a fluid ejecting apparatus which ejects and discharges fluid other than ink and a fluid container which accommodates the fluid may be employed. The invention can be applied to various types of fluid ejecting apparatuses including a fluid ejecting head or the like which discharges a minute liquid droplet. Note that the term "liquid droplet" represents the state of fluid which is discharged from the above fluid ejecting apparatus. A granule form, a teardrop form, and a form that pulls a tail in a string-like form therebehind are included as the liquid droplet. The term "fluid" here represents materials which can be ejected by the fluid ejecting apparatus.

For example, any materials are cited as long as the materials are in a liquid phase. Materials in a liquid state having high viscosity or low viscosity or a fluid state such as sol, gel water, other inorganic solvents, an organic solvent, a solution, a liquid resin or a liquid metal (molten metal) can be cited as the fluid. Further, the fluid is not limited to a fluid as one state of a material but includes a fluid in which particles of a functional material made of a solid material such as pigment particles or metal particles are dissolved, dispersed, or mixed in a solvent. Typical examples of the fluid are ink described in the above embodiments, liquid crystals, and the like. The term "ink" here encompasses various fluid compositions such as common aqueous ink and oil ink, gel ink and hot melt ink.

Specific examples of the fluid ejecting apparatus include a fluid ejecting apparatus which ejects fluid including materials such as an electrode material and a coloring material in a state of being dispersed or dissolved. The materials such as the electrode material and the coloring material are used for manufacturing liquid crystal displays, electroluminescence (EL) displays, surface light emitting displays and color filters, for example. Further, the specific examples of the fluid ejecting apparatus include a fluid ejecting apparatus which ejects a bioorganic material used for manufacturing biochips, a fluid ejecting apparatus which ejects fluid serving as a sample and is used as a precision pipette, printing equipment, and a micro dispenser.

Other examples of the fluid ejecting apparatus may include: a fluid ejecting apparatus which pinpoint-ejects lubricating oil to a precision machine such as a watch or a camera; a fluid ejecting apparatus which ejects a transparent resin solution of an ultraviolet curable resin or the like onto a substrate in order to form a hemispherical microlens (optical lens) used in an optical communication element and the like; and a fluid ejecting apparatus which ejects an acid or alkali etching solution for etching a substrate or the like. The invention can be applied to any one type of the fluid ejecting apparatuses and fluid containers.

The entire disclosure of Japanese Patent Application No. 2010-28877, filed Feb. 12, 2010 is expressly incorporated by reference herein.

What is claimed is:

1. A liquid ejecting apparatus comprising:

a head portion which ejects liquid;

a plurality of liquid reception portions which receive the liquid discharged from the head portion and in which flow-out ports of the liquid are provided on the bottoms;

a suction pump which is connected to each of the flow-out ports of the plurality of the liquid reception portions and sucks the flow-out ports; and closure members each of which is provided in each of the plurality of liquid reception portions, is formed so as to float in the liquid, and closes each of the flow-out ports in a state where the liquid has flown out.

2. The liquid ejecting apparatus according to claim 1, wherein the head portion has a plurality of liquid ejection regions, and the liquid reception portion is provided in each of the liquid ejection regions.

3. The liquid ejecting apparatus according to claim 2, wherein the head portion has a plurality of ejection heads, and the liquid ejection region is provided on each of the ejection heads.

4. The liquid ejecting apparatus according to claim 1, wherein the head portion has a liquid ejection face which ejects the liquid, and the plurality of liquid reception portions are formed so as to cover the liquid ejection face.

* * * * *